US010549884B1

(12) United States Patent
Saggio et al.

(10) Patent No.: US 10,549,884 B1
(45) Date of Patent: Feb. 4, 2020

(54) PALLET ADAPTER

(71) Applicant: The Boeing Company, Chicago, IL (US)

(72) Inventors: Rosario Simon Saggio, Long Beach, CA (US); Behrooz Afghani, Huntington Beach, CA (US); Frank James Caldwell, Jr., Lakewood, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/043,025

(22) Filed: Jul. 23, 2018

(51) Int. Cl.
*B65D 19/38* (2006.01)

(52) U.S. Cl.
CPC .... *B65D 19/38* (2013.01); *B65D 2519/00761* (2013.01)

(58) Field of Classification Search
CPC ..... B65D 19/38; B65D 2519/00761; B65D 2519/00766
See application file for complete search history.

(56) References Cited

U.S. PATENT DOCUMENTS 3,452,958 A * 7/1969 Hambleton ..... B65D 19/0002 248/346.02
3,509,832 A * 5/1970 Daisley, Jr. ..... B65D 19/0002 108/57.25
3,591,121 A * 7/1971 Parris ..... B65D 19/0002 248/346.02
3,622,114 A * 11/1971 McIntire, Jr. ..... B65D 19/0002 248/346.02
4,046,347 A * 9/1977 Bryan ..... B65D 19/00 248/346.02
10,293,974 B1 * 5/2019 Scheer ..... B65D 19/38
2002/0005150 A1 * 1/2002 Taylor ..... B64D 9/00 108/51.11
2008/0237305 A1 * 10/2008 Rennick ..... B23K 20/1225 228/112.1
2009/0025616 A1 * 1/2009 Merrill ..... B29C 65/48 108/57.25
2011/0062301 A1 * 3/2011 Sloan ..... A47B 43/003 248/304
2014/0096708 A1 * 4/2014 Pherson ..... B65D 19/0002 108/56.3
2019/0031078 A1 * 1/2019 Livesay ..... B60P 7/08

* cited by examiner

*Primary Examiner* — Matthew W Ing
(74) *Attorney, Agent, or Firm* — Kolisch Hartwell, P.C.

(57) ABSTRACT

Pallet adapters configured to attach to a selected pallet type in order to render it compatible with a cargo restraint system that is configured for a larger pallet type. The pallet adapters may include two side rails and two end rails, each rail having a slotted inner face to receive the flanges at the sides and ends of the selected pallet type. Each end of the side rails has a connector that can be coupled by a single fastener to a connector on each end of the end rails so that when connected, the side rails and end rails form a rectangular-shaped pallet adapter with inner slots that secure the flanged side edges of the selected pallet type.

20 Claims, 5 Drawing Sheets

PALLET ADAPTER

FIELD

This disclosure relates to cargo restraint systems configured to secure standardized pallets. More specifically, the disclosed embodiments relate to pallet adapters configured to attach to a selected pallet type and render it compatible with a cargo restraint system that is configured for a larger pallet type.

INTRODUCTION

The Civil Reserve Air Fleet (or CRAF) is a government program that is intended to augment the U.S. military's airlift capability when needed. Under the program, U.S. airlines may contractually commit to participation in the CRAF, with the understanding that selected aircraft from the participating airlines may be used in emergencies when the need for cargo transport exceeds the capability of existing military aircraft.

Commercial aircraft are typically outfitted with some form of cargo restraint system that includes longitudinal rails attached to the decking that are sized to accept a standard commercial pallet, and stop devices that either pop up adjacent the rails or that can be inserted to prevent movement of pallets along the rails. The pallets are secured from side-to-side motion by the longitudinal rails, while the stops prevent movement of the pallets in the fore and aft direction.

There are a variety of pallets and containers (sometimes referred to as Unit Load Devices) used by commercial airline operators, in a variety of sizes and configurations. One popular configuration of pallet used for air freight is the Main Deck Pallet (MDP). The MDP and its variants have a footprint of 96"×125", and many cargo restraint systems installed on commercial aircraft are sized to accept a standard 96"×125" MDP pallet. The U.S. Military, on the other hand, have established a standard Military Pallet (the 463L Master Pallet) for military air cargo. The standard Military Pallet is smaller than the MDP commercial pallet, with a footprint of 88"×108", and is better suited for use on military cargo aircraft and for military operations. Military payloads are typically pre-staged on Military Pallets for subsequent transport or air-drop.

The incompatibility of commercial cargo restraint systems with Military Pallets may create a substantial barrier to using commercial aircraft to transport military air cargo. Although commercial aircraft can be refitted to be compatible with military cargo loads by removing and/or adapting the existing cargo restraint systems for use with Military Pallets, converting a commercial aircraft's cargo restraint system from one that is sized to accept the MDP commercial pallet to a restraint system compatible with the smaller Military Pallet would be costly, and therefore not a viable option for most freight carriers. Such a conversion might also be time-consuming, and add additional weight (and therefore operating cost) to the aircraft. Further, the conversion would need to be reversed before the commercial aircraft could return to civilian use, creating yet another burden that an airline operator would be reluctant to assume.

Alternatively, the military cargo may be moved and secured to a different type of pallet, but offloading the existing Military Pallets and reloading and securing the cargo on the differently-sized pallet would require both time and personnel to accomplish, which compromises efficiency and adds significant cost for both the military and commercial airline. Alternatively, the Military Pallets themselves can be loaded onto standard commercial pallets, which are compatible with the existing cargo restraint system. This in turn would require additional straps or cargo netting to secure the cargo and Military Pallet to the commercial pallet, and in turn require personnel to spend considerable time installing the additional fasteners or straps needed in order to secure the Military Pallet to the commercial pallet, and then to uninstall the straps and netting to remove the military pallet, and its secured load, for subsequent loading on a military transport aircraft or vehicle.

What is needed is a system that permits the use of existing commercial aircraft cargo restraint systems with Military Pallets, without requiring excessive time, personnel, or costs.

SUMMARY

The present disclosure provides pallet adapters that may include two side rails and two end rails, where each end of the side rails has a connector that can be coupled by a single fastener to a connector on each end of the end rails so that when connected, the side rails and end rails form a rectangular-shaped that functions as a pallet adapter.

In some embodiments, the disclosure may provide pallet adapters that include first and second side rails, where each side rail has an inner face, and an outer face. Each inner face of the side rails includes a slot running the length of the inner face that is configured to engage a flanged side edge of a selected pallet type. the pallet adapters may also include first and second end rails, where each end rail has an inner face, and an outer face, and each inner face of the end rails includes a slot running the width of the inner face that is configured to engage a flanged end edge of the selected pallet type. Each end of each side rail and each end pf each end rail of the pallet adapters is equipped with either a clevis or a clevis tang of a clevis fastener, so that when the side rails and end rails are assembled to form a rectangle, each corner of the rectangle includes both components of a clevis fastener, and so each corner can be secured by a single clevis pin to form a rectangular pallet adapter that can enfold, receive, and secure the flanged side edges of the selected pallet type.

In some embodiments, the disclosure may provide pallet adapters that may include a first side rail having an inner face facing an inner face of a second side rail, each side rail having a slot along its inner face configured to receive a flanged side edge of a selected pallet type. The pallet adapter may further include a first end rail having an inner face facing an inner face of a second end rail, each end rail having a slot along its inner face configured to receive a flanged end edge of the selected pallet type. Each end of the first side rail and each end of the second side rail may include a connector coupled by a single fastener to a connector on each end of the first and second end rails, so that the connected side rails and end rails form a rectangular-shaped pallet adapter with slots configured to secure to a flanged side edge of the selected pallet type.

In some embodiments, the disclosure may provide a military pallet adapter kit that includes two end rails having slots configured to attach to a flanged edge on the ends of a selected military pallet, each end rail having a clevis tang attached at each end, and two side rails each having slots configured to attach to a flanged edge on the sides of the selected military pallet, each side rail having a clevis attached at each end. The pallet adapter kit may further include four clevis fasteners, each fastener configured to threadedly connect each clevis tang within its corresponding clevis, so that the connected end rails and side rails form a rectangular-shaped pallet adapter with slots configured to secure to a flanged edge of the selected military pallet.

The disclosed features, functions, and advantages of the disclosed pallet adapters and pallet adapter kits may be achieved independently in various embodiments of the present disclosure, or may be combined in yet other embodiments, further details of which can be seen with reference to the following description and drawings.

DESCRIPTION

Although the present disclosure may be frequently described in the context of the LD7 commercial pallet and the military's 463L Master Pallet, it should be appreciated that the pallet adapters of the disclosure may be useful for adapting any of a variety of smaller pallet sizes and rendering them compatible with cargo restraint system that are configured for target pallets having larger dimensions.

Figure 1:
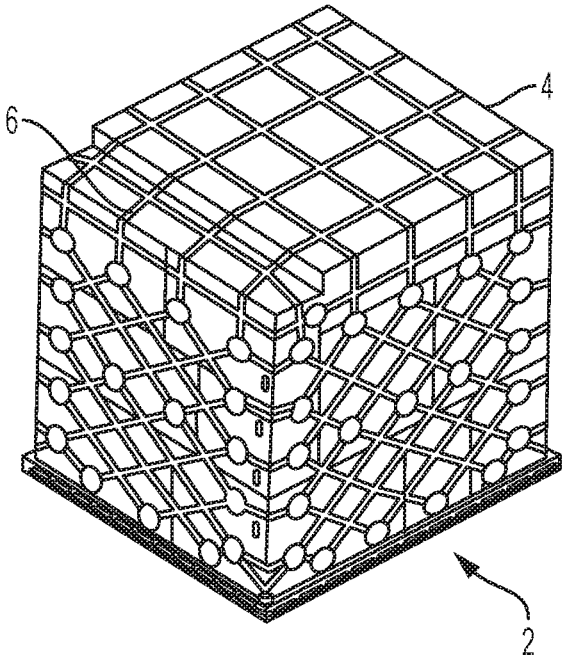
FIG. 1 PRIOR ART
FIG. 1 depicts a loaded Military Pallet, showing the cargo secured by a cargo net.

FIG. 1 depicts a conventional Military Pallet 2, as used by the U.S. Military, with an associated cargo load 4 secured by cargo netting 6. The Military Pallet is fundamentally incompatible with a cargo restraint system sized to accept and secure MDP commercial pallets.

Figure 2:
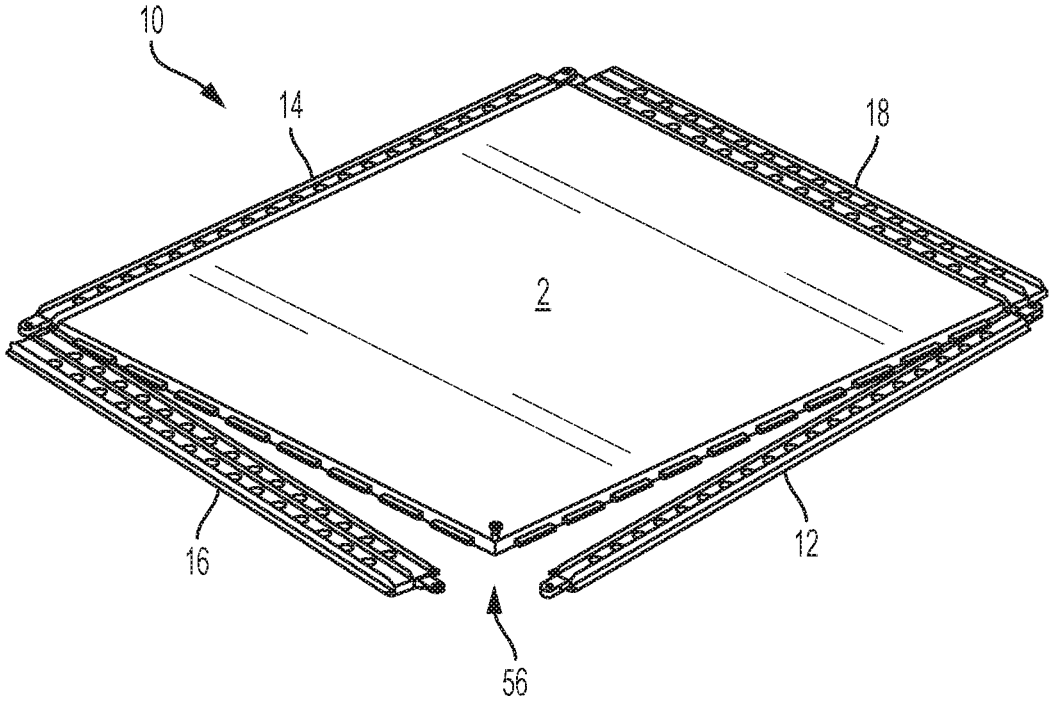
FIG. 2 depicts a Military Pallet with an illustrative pallet adapter of the present disclosure partially attached to the Military Pallet.

FIG. 2 depicts a Military Pallet 2 (the cargo is not shown) in combination with a pallet adapter 10 according to the present disclosure. The pallet adapter 10 is not fully secured to the Master Pallet 2, as one of the four fasteners that secures pallet adapter 10 in place is not secured. As shown in FIG. 2, by removing a single fastener, pallet adapter 10 can be opened (unfolded) and removed from the Master Pallet 2. The opened pallet adapter 10 can equally quickly be folded around and mated to a Master Pallet 2, and the fourth fastener inserted and secured to render the Master Pallet 2 fully compatible with the desired cargo restraint system.

Figure 3:
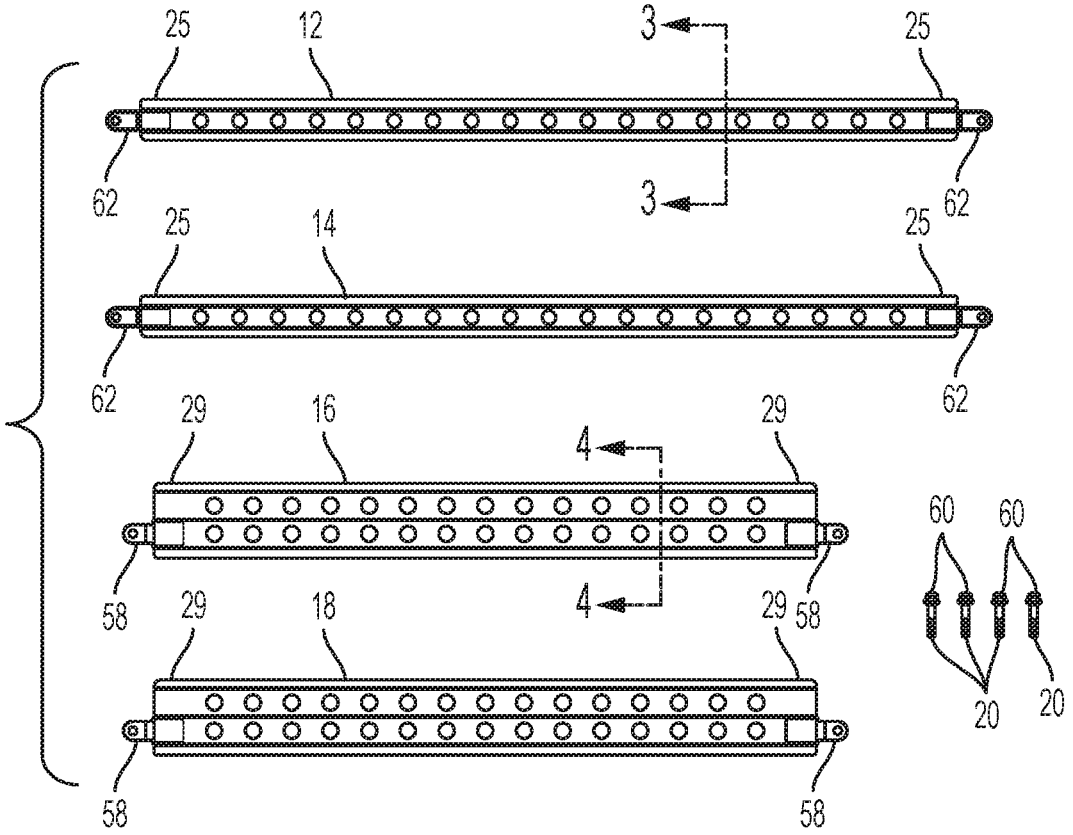
FIG. 3 depicts components of an illustrative pallet adapter according to the present disclosure.

Pallet adapter 10 of FIG. 2 is shown disassembled and in greater detail in FIG. 3. Pallet adapter 10 includes a first side rail 12 and a second side rail 14, a first end rail 16 and a second end rail 18, and four fastener pins 20. The side rails 12 and 14 have a width selected so that when both side rails are coupled to the sides of a smaller pallet, the resulting increased width corresponds to a width of a target pallet size. Similarly, the end rails 16 and 18 have a width selected so that when both end rails are coupled to the ends of the smaller pallet, the resulting increased length corresponds to the length of the target pallet size.

Each side rail 12 and 14 has an inner face 22, an outer face 24, and two ends 25. Similarly, each end rail 16 and 18 has an inner face 26, an outer face 28, and two ends 29. In order to securely couple to the smaller pallet, each inner face of each side rail defines a slot 30 running a length of the inner face that is configured to engage the flange present on a corresponding side a selected smaller pallet type. Similarly, each inner face 26 of each end rail defines a corresponding slot 32 running a length of the inner face configured to engage the flange present on a corresponding end of the selected smaller pallet type.

Figure 4:
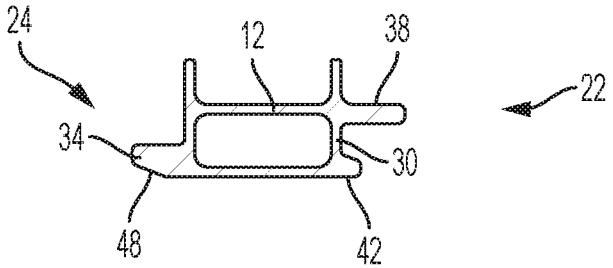
FIG. 4 is a cross-section view of a side rail as indicated in FIG. 3.
Figure 5:
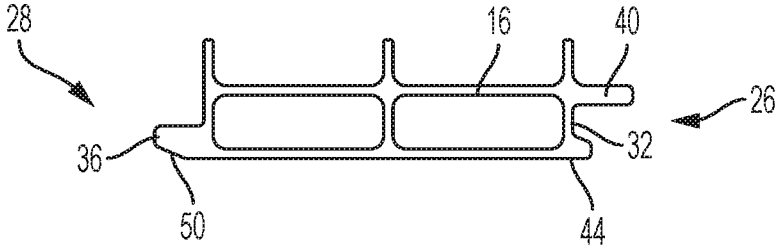
FIG. 5 is a cross-section view of an end rail as indicated in FIG. 3.

FIGS. 4 and 5 depict cross-sectional views of a side rail 12 and an end rail 16, respectively, revealing the structures of the two rail types which maximizes strength and rigidity while minimizing weight. Although the pallet adapters of the present disclosure may be manufactured from any suitable material or combination of materials, it should be appreciated that the resulting adapter should be light in weight, strong, and rigid. Although materials such as titanium and carbon composite materials may provide advantageous properties, their use may be prohibitively expensive. It may be preferable to manufacture the side and end rails of the pallet adapter from a relatively inexpensive material such as aluminum.

In addition, FIGS. 4 and 5 shows the profile of inner slots 30 and 32, which are configured to engage an existing flange on a smaller pallet. Slots 30 and 32 are defined by an upper flange 38, 40 and a lower beveled lip 42, 44. Where the disclosed pallet adapter 10 is intended to be used with a Military Pallet, the side and end rails of pallet adapter 10 are preferably configured to engage the flanged edges of the Master Pallet with no or only minimal interference with any of the plurality of cargo tiedown devices present on the edges of the Master Pallet.

In order for the pallet adapter to be fully compatible with an existing cargo restraint system, the side rails and end rails of the pallet adapter should additionally include a flange 34, 36 defined on the corresponding outer faces 24, 28 that is configured to interact with the existing cargo restraint system. Flanges 34 and 36 are clearly shown in the cross-sectional views of FIGS. 4 and 5, including the chamfered lower edges 48, 50 of Flanges 34 and 36. Upon assembly, the two side rail outer flanges 34 and end rail outer flanges 36, considered in combination, define a perimeter of the resulting rectangular pallet adapter 10.

Although the slots 30 and 32 are not necessarily identical in configuration, for most commercial pallets the flanges on the sides and ends of the pallet have the same dimensions, and so slots 30 and 32 will most typically be equivalent in depth and profile. Similarly, outer flanges 34 and 36 need not be identical in configuration, but will most typically be equivalent in depth and profile.

Figure 6:
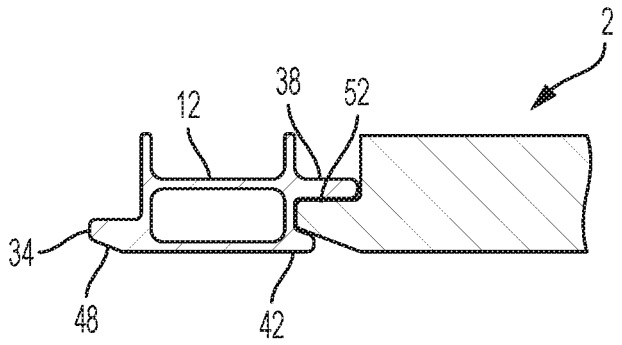
FIG. 6 is a cross-section view of the side rail of FIG. 4 engaged by a side flange of a smaller pallet.
Figure 7:
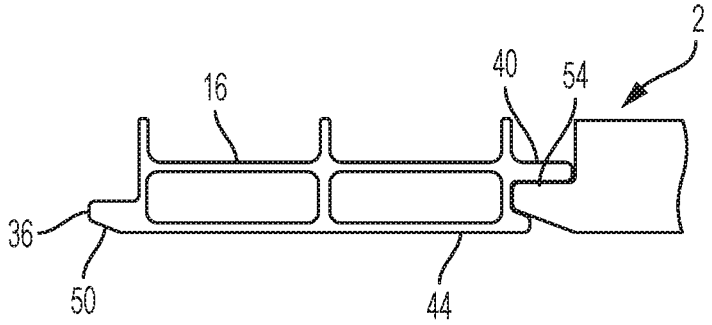
FIG. 7 is a cross-section view of the end rail of FIG. 5 engaged by an end flange of a smaller pallet.

FIG. 6 shows the interaction of a flange 52 present on a side of a smaller pallet with side rail inner slot 30, while FIG. 7 shows the interaction of a flange 54 present on an end of a smaller pallet with end rail inner slot 32. In particular, FIGS. 6 and 7 depict the interaction of a side rail 12 and an end rail 16 with the flanges 52 and 54, respectively, of Master Pallet 2.

In order for the pallet adapter 10 of the disclosure to be secured to a smaller pallet, the two side rails and two end rails may be coupled to one another. For example, the ends of the side rails and end rails may include the components of a suitable fastening device, so that each corner of the pallet adapter 10 includes a corner fastener 56. Although any fastener that can be configured to join an end rail and side rail, while being small enough to avoid interference with cargo handling procedures, may be a suitable fastener for the purposes of this disclosure. Preferably, however, the fasteners 56 are selected so that they may be quickly and efficiently secured and released by aircraft personnel. For this reason, it is preferably that fasteners 56 can be secured by a single fastener part, such as a fastener pin 20.

Figure 8:
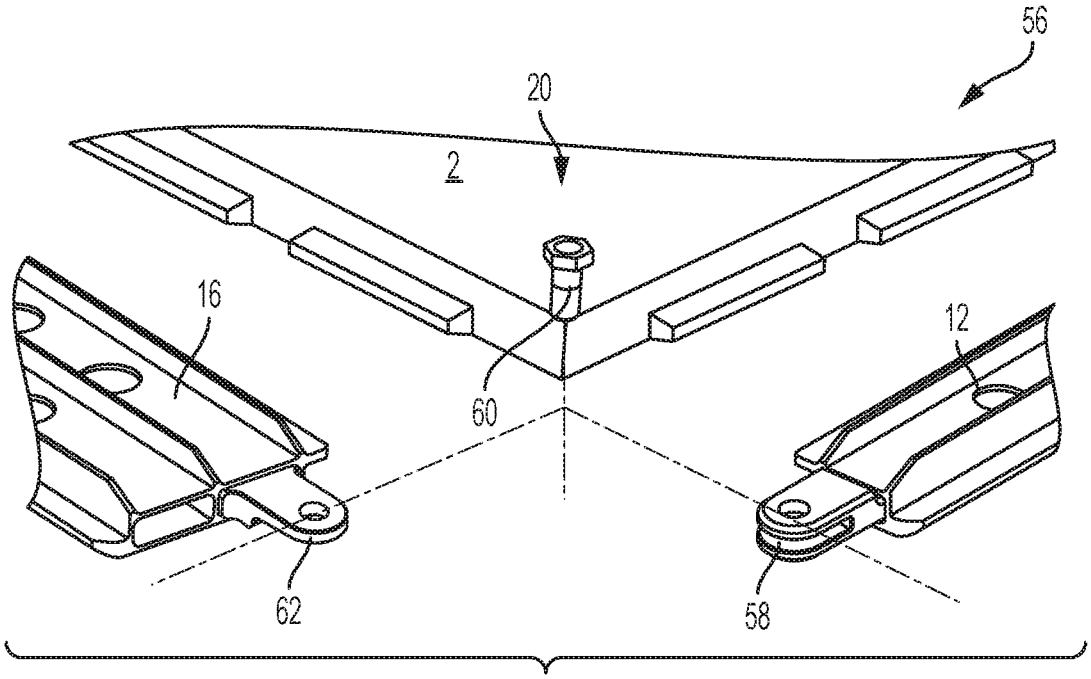
FIG. 8 depicts an illustrative corner fastener of a pallet adapter of the present disclosure.

In one aspect of the disclosed pallet adapter, each corner fastener 56 is a clevis fastener, or three-piece fastener system, as shown in FIG. 8. Each clevis corner fastener 56 may include a clevis 58 having a U-shaped portion, where the prongs of the U-shaped portion include apertures configured to accept a clevis pin 60. The clevis tang 62 is configured to be interposed between the prongs of the clevis 58 and secured in place by insertion of clevis pin 60. Clevis pin 60 may be retained in clevis fastener 56 by any suitable retention mechanism or mechanisms, such as by gravity, by cotter pin, or by threaded interconnection with the clevis 58, among others. Typically, an advantageous compromise between ease of use, speed of operation, and security of the fastener has each clevis pin 60 at least partially threaded and configured to threadedly engage the lower prong of the corresponding clevis 58. In one aspect of the disclosure, each clevis pin 60 includes a shoulder bolt that is configured to threadedly engage a lower arm of a corresponding clevis 58. Each clevis pin 60 may additionally be secured to a corresponding clevis 58 for example by a lanyard 64 or wire attachment, so that the clevis pin is not misplaced, as shown in FIG. 9.

In order to simplify assembly of pallet adapter 10, the components of clevis fastener 56 should be arranged on side rails 12, 14 and end rails 16, 18 in such a way that every combination and arrangement of side rails and end rails results in both a clevis 58 and clevis tang 62 at their intersection. For example, the same fastener component may be present at the first and second ends of each side rail, with the complementary fastener component present at the first and second ends of each end rail. As shown in FIG. 3, each end rail 16, 18 includes a clevis tang 62 at each end of the rail, while each side rail 12, 14 includes a clevis 58 at each end of the rail. In this way, the intersection of any side rail with any end rail will provide both a clevis 58 and clevis tang 62, requiring only the insertion of clevis pin 60 to secure the two rails together.

Figure 9:
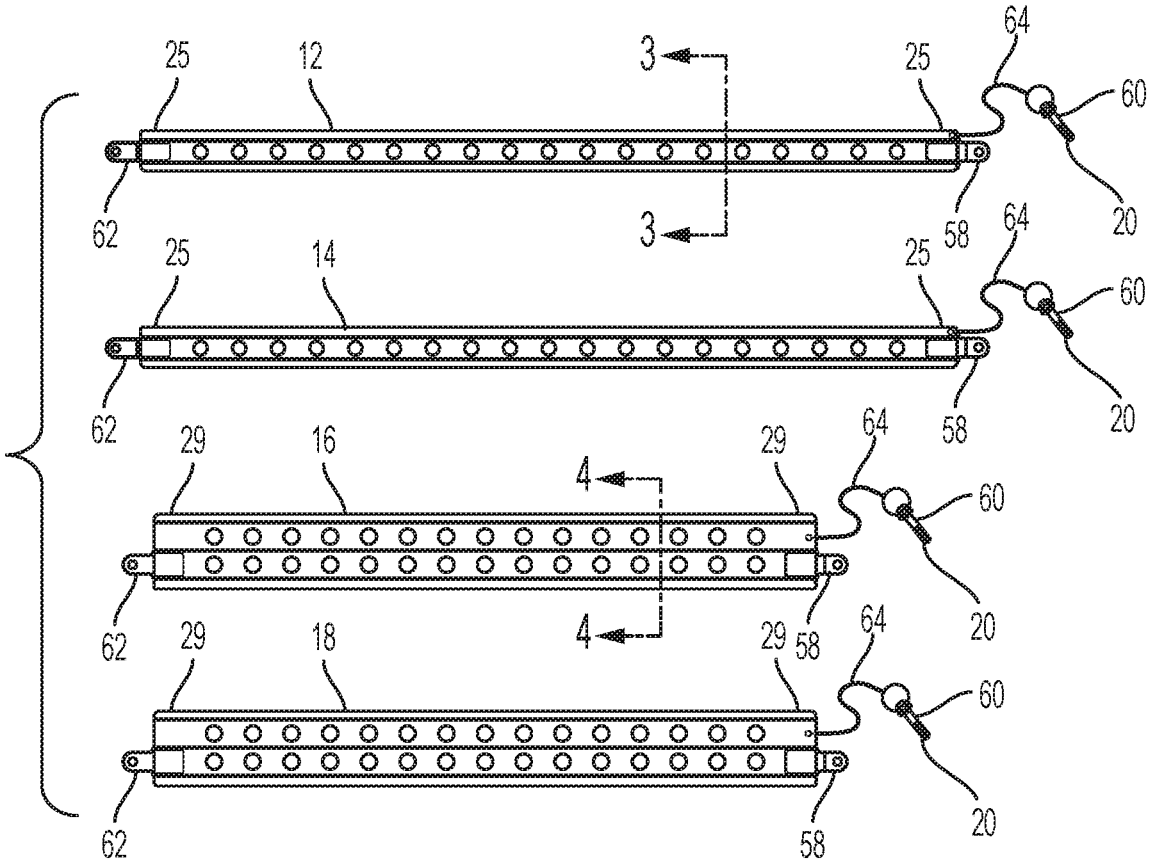
FIG. 9 depicts components of an alternative illustrative pallet adapter according to the present disclosure.

Alternatively, each side rail 12, 14 and each end rail 16, 18 may include one of each type of fastener component as shown in FIG. 9, provided that the disposition of the components is consistent for every rail. For example, when viewing the outer face of any given rail, if the 10 left-hand end is always modified with a clevis 58, and the right-hand end is always modified with a clevis tang 62, every combination of side rails and end rails with result in a both components at each corner.

As an additional advantage, by virtue of this construction the clevis fastener 56 at each corner of pallet adapter 10 may additionally function as a pivot point, or hinge. The pallet adapter may therefore be quickly and efficiently removed from a smaller pallet by the removal of a single fastener, followed by unfolding the pallet adapter away from the smaller pallet, as shown in FIG. 2. That is, the entire pallet adapter 10 can be removed without requiring the disconnection of all four corner fasteners. Similarly, a pallet adapter 10 that has already been connected at three of four corners can be installed on a smaller pallet by enfolding and receiving the smaller pallet, and the fastening of the fourth clevis fastener 56.

Figure 10:
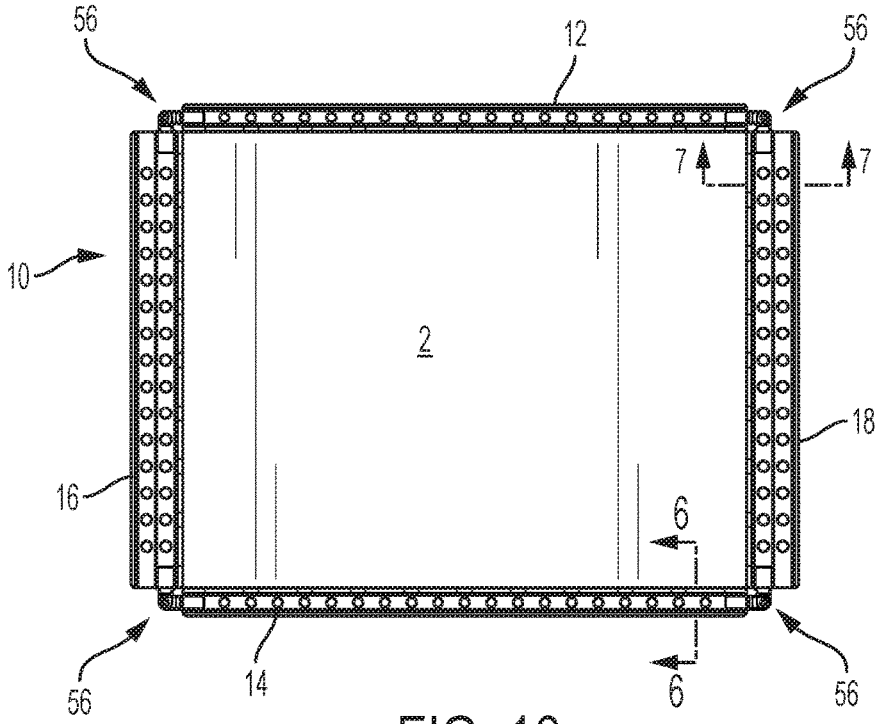
FIG. 10 is a plan view of the pallet adapter of FIG. 3 secured to a Military Pallet.
Figure 11:
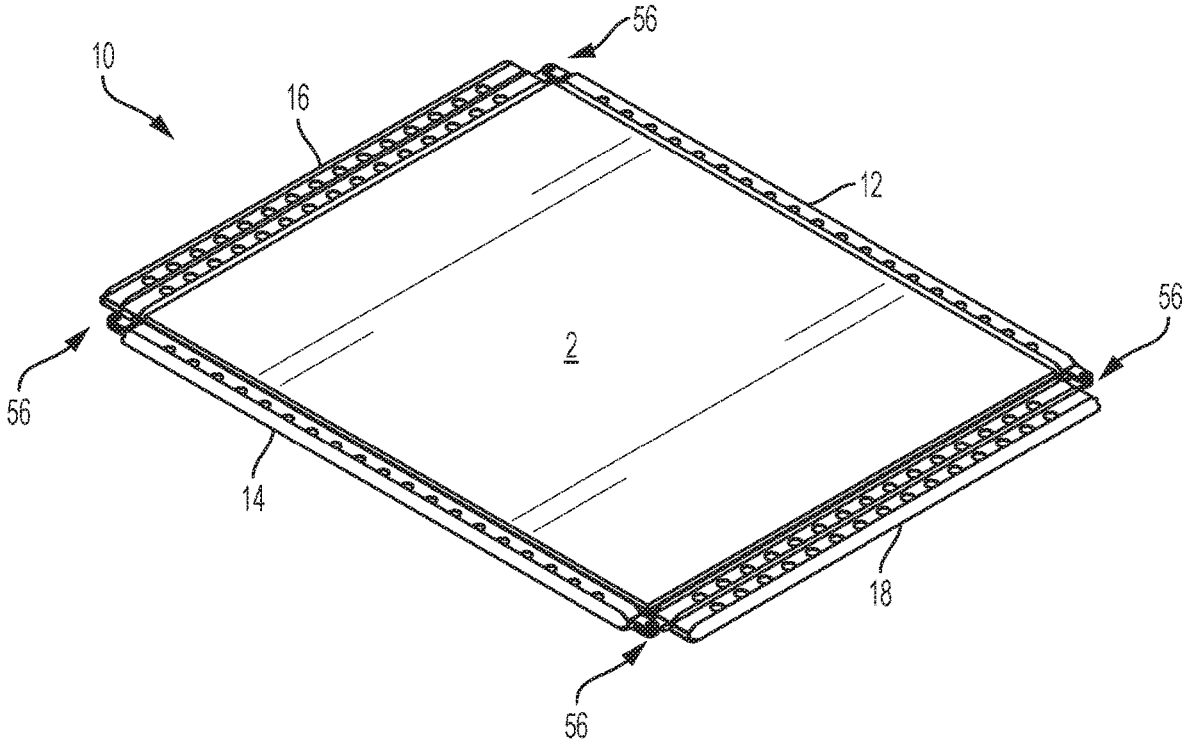
FIG. 11 is an isometric view of the pallet adapter of FIG. 3 secured to a Military Pallet.

In a preferred embodiment of the disclosure, pallet adapter 10 is configured so that side rails 12, 14 and end rails 16, 18 can engage and secure a smaller pallet having a width of about 88 inches and a length of about 108 inches. Alternatively or in addition, side rails 12, 14 and end rails 16, 18 may be configured so that upon engagement with the selected smaller pallet type the pallet adapter has a width of about 96 inches and a length of about 125 inches. More specifically, the pallet adapter 10 may be configured to engage the flanged edges of a Military Pallet, and further configured so that when pallet adapter 10 has engaged the Military Pallet, the Military Pallet is rendered compatible with a cargo restraint system used on a commercial cargo aircraft, as shown in FIGS. 10 and 11.

The pallet adapter 10 of the present disclosure may additionally or alternatively be formulated as a pallet adapter kit, and more particularly as a military pallet adapter kit, where the adapter kit includes two end rails 16, 18 each having slots 32 configured to attach to a flange 54 on an end of a selected military pallet, each end rail 16, 18 having a clevis tang 62 attached at each end of the rail. The adapter kit may further include two side rails 12, 14 each having slots 30 configured to attach to a flange 52 on a side of a selected military pallet, each side rail 12, 14 having a clevis 58 attached at each end. The military pallet adapter kit may further include four clevis fasteners 60, each configured to threadedly connect each clevis tang 62 within its corresponding clevis 58, such that the connected end rails 16, 18 and side rails 12, 14 form a rectangular-shaped pallet adapter 10 with slots 30, 32 configured to secure to a flanged edge of the selected military pallet. The resulting military pallet adapter kit may additionally be configured for use with a Military Pallet, so that each end rail 16, 18 is about 88 inches in length exclusive of the clevis tangs 62, and about 4 inches in width; and each side rail 12, 14 is about 108 inches in length exclusive of clevises 58, and about 8.5 inches in width.

The following section describes additional aspects and features of the disclosed pallet adapters, and pallet adapter kits, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A1. A pallet adapter, comprising: a first side rail and a second side rail, each side rail having an inner face and an outer face, wherein the inner face of each side rail defines a slot running a length of the inner face that is configured to engage a flanged side edge of a selected pallet type; a first end rail and a second end rail, each end rail having an inner face and an outer face, wherein the inner face of each end rail defines a slot running a width of the inner face that is configured to engage a flanged end edge of the selected pallet type; wherein each end of each side rail and each end rail is equipped with either a clevis or a clevis tang of a clevis fastener, such that when the side rails and end rails are assembled alternately and end-to-end to form a rectangle, each corner of the rectangle includes both the clevis and the clevis tang of the clevis fastener, and each corner can be secured by a single clevis pin to form a rectangular adapter that is configured to enfold, receive, and secure the flanged side edges of the selected pallet type.

A2. The pallet adapter of paragraph A1, wherein each end rail and each side rail include both the clevis and the clevis tang disposed at opposing ends of the rail.

A3. The pallet adapter of paragraph A1, wherein each end rail includes two clevises disposed at the ends of the end rails, and each side rail includes two clevis tangs disposed at the ends of the side rails.

A4. The pallet adapter of paragraph A1, wherein each rail end that includes a clevis also includes a clevis pin secured to the rail by a lanyard.

A5. The pallet adapter of paragraph A1, wherein the clevis fastener at each corner of the rectangular pallet adapter is a pivotable connection, so that a removal of any single clevis pin enables the pallet adapter to unfold and become removable from a pallet secured by the adapter.

A6. The pallet adapter of paragraph A1, wherein each clevis pin comprises a shoulder bolt that threadedly engages a lower arm of the corresponding clevis.

A7. The pallet adapter of paragraph A1, wherein the rectangular pallet adapter has an increased width and an increased length relative to the selected pallet type.

A8. The pallet adapter of paragraph A1, further comprising a flange on the outer face of each of the side rails, and a flange on the outer face of each of the end rails, such that the flanges define a perimeter of the rectangular pallet adapter.

A9. The pallet adapter of paragraph A8, wherein the flange on the outer face of each of the side rails, and the flange on the outer face of each of the end rails, has a chamfered lower edge.

A10. The pallet adapter of paragraph A8, wherein the flanges disposed on the perimeter of the rectangular pallet adapter are appropriately shaped and sized so that the pallet adapter is compatible with a cargo restraint system configured for a larger pallet type.

A11. The pallet adapter of paragraph A10, wherein the pallet adapter is compatible with a container handling system configured for use on a commercial cargo aircraft.

B1. A pallet adapter, comprising: a first side rail having an inner face facing an inner face of a second side rail, each side rail having a slot along its inner face configured to receive a flanged side edge of a selected pallet type; a first end rail having an inner face facing an inner face of a second end rail, each end rail having a slot along its inner face configured to receive a flanged end edge of the selected pallet type; each end of the first side rail and each end of the second side rail having a connector that is coupled by a single fastener to a connector on each end of the first end rail and second end rail, such that the connected side rails and end rails form a rectangular-shaped pallet adapter with slots configured to secure to a flanged side edge of the selected pallet type.

B2. The pallet adapter of paragraph B1, wherein the connector on each end of the side rails and connector on each end of the end rails are configured to be coupled by a single fastener such that removal of any single fastener enables the pallet adapter to unfold and separate from a selected pallet that the pallet adapter is secured to.

B3. The pallet adapter of paragraph B1, wherein the first and second side rails and first and second end rails are sized so that they are configured to engage and secure a selected pallet type having a width of about 88 inches and a length of about 108 inches.

B4. The pallet adapter of paragraph B1, wherein the first and second side rails and first and second end rails are sized so that upon engagement with the selected pallet type the pallet adapter has a width of about 96 inches and a length of about 125 inches.

B5. The pallet adapter of paragraph B1, wherein the rectangular adapter is configured to engage the flanged edges of a Military Pallet, wherein when the adapter has engaged the Military Pallet, the Military Pallet is rendered compatible with a cargo restraint system used on a commercial cargo aircraft.

B6. The pallet adapter of paragraph B5, wherein the rectangular adapter is configured to engage the flanged edges of a Military Pallet without interfering with any of a plurality of tiedowns on the edges of the Military Pallet.

B7. The pallet adapter of paragraph B1, wherein when the adapter is engage with the selected pallet type, each side rail is fastened to two end rails with clevis fasteners, and each end rail is fastened to two side rails with clevis fasteners, where each clevis fastener includes a clevis, a clevis tang, and a clevis pin engaged with the clevis; wherein removing a single clevis pin from the adapter permits the adapter to be unfolded and removed from the selected pallet type.

C1. A military pallet adapter kit, comprising: two end rails each having slots configured to attach to a flanged edge on the ends of a selected military pallet, each end rail having a clevis tang attached at each end; two side rails each having slots configured to attach to a flanged edge on the sides of the selected military pallet, each side rail having a clevis attached at each end; and four clevis fasteners, each configured to threadedly connect each clevis tang within its corresponding clevis, such that the connected end rails and side rails form a rectangular-shaped pallet adapter with slots configured to secure to a flanged edge of the selected military pallet.

C2. The military pallet adapter kit of paragraph C1, wherein each end rail is about 88 inches in length exclusive of the clevis tangs, and about 4 inches in width; each side rail is about 108 inches in length exclusive of clevises, and about 8.5 inches in width.

ADVANTAGES, FEATURES, BENEFITS

The different embodiments and examples of the methods, apparatus, and systems described herein provide several advantages over previous approaches for accommodating different pallet sizes during cargo transfer.

The pallet adapters disclosed herein would permit airline operators to accept and transport cargo secured onto pallets that are smaller in one or more dimensions than the pallet size that their existing cargo restraint systems was designed for. In particular, the disclosed pallet adapters would permit airline operators to participate in the CRAF program without the necessity of removing and replacing their existing cargo restraint systems. For this reason the disclosed pallet adapters are particularly useful for permitting military standard Military Pallets to be secured using cargo restraint systems configured for conventional LD7 pallets.

In addition to the cost savings associated with utilizing an existing cargo restraint system, the disclosed pallet adapters are configured to be attached to an existing pallet quickly and without specialized training, with the corner couplings requiring a single fastener to completely secure the adapter in place. Similarly, by removing a single fastener, the pallet may be quickly unfolded and opened to remove the adapter completely when desired.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A pallet adapter, comprising:

a first side rail and a second side rail, each side rail having an inner face and an outer face, wherein the inner face of each side rail defines a slot running a length of the inner face that is configured to engage a flanged side edge of a selected pallet type; and a first end rail and a second end rail, each end rail having an inner face and an outer face, wherein the inner face of each end rail defines a slot running a width of the inner face that is configured to engage a flanged end edge of the selected pallet type;

wherein each end of each side rail and each end of each end rail is equipped with either a clevis or a clevis tang of a clevis fastener, such that when the side rails and end rails are assembled alternately and end-to-end to form a rectangle, each corner of the rectangle includes both the clevis and the clevis tang of the clevis fastener, and each corner can be secured by a single clevis pin to form a rectangular adapter that is configured to enfold, receive, and secure the flanged side edges of the selected pallet type;

wherein the clevis fastener at each corner of the rectangular pallet adapter is a pivotable connection, so that a removal of any single clevis pin enables the pallet adapter to unfold and become removable from a pallet secured by the adapter, without requiring the disconnection of all four corner clevis fasteners.

2. The pallet adapter of claim 1, wherein each end rail and each side rail include both the clevis and the clevis tang disposed at opposing ends of the rail.

3. The pallet adapter of claim 1, wherein each end rail includes two devises disposed at the ends of the end rails, and each side rail includes two clevis tangs disposed at the ends of the side rails.

4. The pallet adapter of claim 1, wherein each rail end that includes a clevis also includes a clevis pin secured to the rail by a lanyard.

5. The pallet adapter of claim 1, wherein each clevis pin comprises a shoulder bolt that threadedly engages a lower arm of the corresponding clevis.

6. The pallet adapter of claim 1, wherein the rectangular pallet adapter has an increased width and an increased length relative to the selected pallet type.

7. The pallet adapter of claim 1, further comprising a flange on the outer face of each of the side rails, and a flange on the outer face of each of the end rails, such that the flanges define a perimeter of the rectangular pallet adapter.

8. The pallet adapter of claim 7, wherein the flange on the outer face of each of the side rails, and the flange on the outer face of each of the end rails, has a chamfered lower edge.

9. The pallet adapter of claim 7, wherein the flanges disposed on the perimeter of the rectangular pallet adapter are appropriately shaped and sized so that the pallet adapter is compatible with a cargo restraint system configured for a larger pallet type.

10. The pallet adapter of claim 9, wherein the pallet adapter is compatible with a container handling system configured for use on a commercial cargo aircraft.

11. The pallet adapter of claim 1, wherein the slots in each side rail and each end rail are defined by an upper flange and a lower beveled lip.

12. The pallet adapter of claim 1, wherein the cross-sections of the side rails have a structure comprising a rectangular tube and the cross-sections of the end rails have a structure comprising two rectangular tubes, and wherein the first and second side rails and first and second end rails have a respective width so that when the first and second side rails and first and second end rails are coupled to a selected pallet the resulting increased width and increased length of the selected pallet with the pallet adapter has a width of about 96 inches and a length of about 125 inches.

13. A pallet adapter, comprising:

a first side rail having an inner face facing an inner face of a second side rail, each side rail having a slot along its inner face configured to receive a flanged side edge of a selected pallet type; and a first end rail having an inner face facing an inner face of a second end rail, each end rail having a slot along its inner face configured to receive a flanged end edge of the selected pallet type;

each end of the first side rail and second side rail having a connector that is coupled by a single fastener to a connector on each end of the first end rail and second end rail, such that the connected side rails and end rails form a rectangular-shaped pallet adapter with slots configured to secure to a flanged side edge of the selected pallet type;

wherein when the adapter is engaged with the selected pallet type, each side rail is fastened to two end rails with clevis fasteners, and each end rail is fastened to two side rails with clevis fasteners, where each clevis fastener includes a clevis, a clevis tang, and a clevis pin engaged with the clevis such that each clevis fastener is a pivotal connection; and wherein removing a single clevis pin from the adapter permits the adapter to be unfolded and removed from the selected pallet type without requiring the disconnection of all four corner clevis fasteners.

14. The pallet adapter of claim 13, wherein the connector on each end of the side rails and connector on each end of the end rails are configured to be coupled by a single fastener such that removal of any single fastener enables the pallet adapter to unfold and separate from a selected pallet that the pallet adapter is secured to.

15. The pallet adapter of claim 13, wherein the first and second side rails and first and second end rails are sized so that they are configured to engage and secure a selected pallet type having a width of about 88 inches and a length of about 108 inches.

16. The pallet adapter of claim 13, wherein the first and second side rails and first and second end rails are sized so that upon engagement with the selected pallet type the pallet adapter has a width of about 96 inches and a length of about 125 inches.

17. The pallet adapter of claim 13, wherein the rectangular adapter is configured to engage the flanged edges of a Military Pallet, wherein when the adapter has engaged the Military Pallet, the Military Pallet is rendered compatible with a cargo restraint system used on a commercial cargo aircraft.

18. The pallet adapter of claim 17, wherein the rectangular adapter is configured to engage the flanged edges of a Military Pallet without interfering with any of a plurality of tiedowns on the edges of the Military Pallet.

19. The pallet adapter of claim 13, wherein the slots in each side rail and each end rail are defined by an upper flange and a lower beveled lip.

20. The pallet adapter of claim 13, wherein the cross-sections of the side rails have a structure comprising a rectangular tube and the cross-sections of the end rails have a structure comprising two rectangular tubes, and wherein the first and second side rails and first and second end rails have a respective width so that when the first and second side rails and first and second end rails are coupled to a selected pallet the resulting increased width and increased length of the selected pallet with the pallet adapter has a width of about 96 inches and a length of about 125 inches.

* * * * *